US008925138B2

(12) United States Patent
Kluge, Jr. et al.

(10) Patent No.: US 8,925,138 B2
(45) Date of Patent: Jan. 6, 2015

(54) BOTTLE CLEANING BRUSH

(76) Inventors: Robert Joseph Kluge, Jr., Richland, MI (US); Casey Hayes Kluge, Wyoming, MI (US)

( * ) Notice: Subject to any disclaimer, the term of this patent is extended or adjusted under 35 U.S.C. 154(b) by 298 days.

(21) Appl. No.: 13/590,256

(22) Filed: Aug. 21, 2012

(65) Prior Publication Data

US 2014/0053355 A1 Feb. 27, 2014

Related U.S. Application Data

(60) Provisional application No. 61/575,600, filed on Aug. 24, 2011.

(51) Int. Cl.
*A47L 17/00* (2006.01)

(52) U.S. Cl.
USPC ..... 15/211; 15/209.1; 15/210.1

(58) Field of Classification Search
CPC . A47L 15/0065; A47L 15/0068; A47L 17/00; A47L 13/12; A47L 13/16; A46B 2200/3006; A46B 13/005; A46B 5/0012
USPC ..... 15/209.1, 210.1, 228, 211
See application file for complete search history.

(56) References Cited

U.S. PATENT DOCUMENTS

| | | | | | |
|---|---|---|---|---|---|
| 463,835 | A * | 11/1891 | Howland | ..... | 15/213 |
| 701,084 | A * | 5/1902 | Pindstofte | ..... | 15/213 |
| 1,837,904 | A * | 12/1931 | Hanelt | ..... | 415/148 |
| 2,584,503 | A * | 2/1952 | Schleenbaker | ..... | 15/164 |
| 2,893,029 | A * | 7/1959 | Vosbikian et al. | ..... | 15/118 |
| 5,953,784 | A * | 9/1999 | Suzuki et al. | ..... | 15/209.1 |
| 7,261,486 | B2 * | 8/2007 | Jian et al. | ..... | 401/291 |
| 2004/0177864 | A1 * | 9/2004 | Segalla | ..... | 134/8 |

* cited by examiner

*Primary Examiner* — Laura C Guidotti
(74) *Attorney, Agent, or Firm* — Hultman Law, PLC; Eric Andrew Hultman, Esq.

(57) ABSTRACT

An improved brush assembly is presented herein comprising a first shaft receiving a second shaft having an outer diameter, creating a shaft assembly. A slot is cut into the second shaft from an outer end to a point proximate the first shaft. A jacket is fitted over a portion of the second shaft, and a cleaning assembly is inserted into and retained in the slot of the shaft assembly. The cleaning assembly comprises a bottom cleaning member and a side cleaning member, wherein the bottom cleaning member comprises a retainer and a cleaning pad extending beyond the end of the second shaft, and the side cleaning member comprises a side cleaning paddle extending beyond an outer diameter of the hollow shaft.

20 Claims, 5 Drawing Sheets

BOTTLE CLEANING BRUSH

CROSS REFERENCE TO RELATED APPLICATION

This application claims the benefit of U.S. Provisional Application No. 61/575,600, filed Aug. 24, 2011, the contents of which are incorporated herein by reference.

BACKGROUND OF THE INVENTION

1. Field of the Invention

This invention relates to a cleaning device, and particularly to a brush for cleaning bottles.

2. Description of the Related Art

Bottles have traditionally been used to transport, store, and dispense fluids, including chemicals and foodstuffs. To prevent contamination and spoilage of the contents held within the bottle, the surfaces that come into contact with the fluid must be cleaned prior to the filling of the bottle. Traditional methods of cleaning include the use of liquid chemicals such as soap or bleach, and steam of sufficient temperature to kill bacteria. However, these prior art methods have difficulty in removing solid deposits, dried fluids, and debris.

Prior art solutions to this dilemma including inserting a physical brush into the container, however many prior art devices do not adequately clean the containers because they fail to properly orient their cleaning surfaces against the container's walls. Concerning bottles, the most difficult part to clean is the transition between the sidewall and the base of the container, and most prior art bottle cleaners have a particular difficulty in contacting and cleaning these surfaces.

The invention described herein provides a solution to the problems described above and provides an improved device for bottle cleaning.

SUMMARY OF THE INVENTION

An improved brush assembly is presented herein comprising a first shaft receiving a second shaft having an outer diameter, creating a shaft assembly. A slot is cut into the second shaft from an outer end to a point proximate the first shaft. A jacket is fitted over a portion of the second shaft, and a cleaning assembly is inserted into and retained in the slot of the shaft assembly. The cleaning assembly comprising a bottom cleaning member and a side cleaning member, the bottom cleaning member comprising a retainer and a bottom cleaning pad extending beyond the end of the second shaft, and the side cleaning member comprising a side cleaning paddle extending beyond an outer diameter of the hollow shaft.

Another embodiment of the invention includes a brush assembly comprising a first shaft, and a second shaft having at least a first end, a second end, and an outer diameter, wherein the first end of the second shaft is fitted over a portion of the first shaft. A slot of predetermined length extends longitudinally through the second shaft from a second end to a point proximate the end of the first shaft. A jacket is disposed over the second shaft as well as a portion of the first shaft. A cleaning assembly is inserted into and retained within the slot, the cleaning assembly comprising a bottom cleaning member and a side cleaning member, the bottom cleaning member further comprising a first retainer having a first width no wider than the second shaft's outer diameter, and a first length no longer than the slot's predetermined length, the retainer attached to a bottom cleaning pad extending beyond the second end of the second shaft, having a width wider than the outer diameter of the shaft. A side cleaning member comprising: a second retainer, sized to match the first bottom cleaning member's retainer; a second bottom cleaning pad, sized to match the first bottom cleaning pad; and a first side cleaning paddle attached to a first side of the second retainer, wherein the paddle extends beyond the outer diameter of the second shaft. The side cleaning member further includes a second side cleaning paddle attached to a second side of the second retainer, extending beyond the outer diameter of the second shaft.

A further embodiment of the invention includes a brush assembly comprising a hollow cylindrical second shaft affixed onto a solid cylindrical first shaft with adhesive, the second shaft comprising a first end, a second end, and an outer diameter. A longitudinal slot of a predetermined length is cut into the second shaft from the second end to a point proximate the end of the first shaft, creating an upper and lower portion on the second shaft. The brush assembly further comprising a plurality of pins inserted through the second shaft into the first shaft anchoring them together. A jacket of reduced heat shrink material is fitted over the entirety of the second shaft and a portion of the first shaft. A cleaning assembly is inserted into and retained within the slot by an adhesive joining the cleaning assembly to the hollow shaft. The cleaning assembly further comprising four bottom cleaning members, and a side cleaning member, each constructed of a fibrous cloth material. The bottom cleaning members further including a first rectangular retainer, and a first rectangular bottom cleaning pad, wherein the first rectangular retainer includes a first width corresponding to the second shaft's outer diameter, and a first length corresponding to the predetermined length of the slot. A first rectangular bottom cleaning pad is attached to the retention retainer, comprising a first bottom cleaning paddle extending beyond the second end of the second shaft, having a width wider than the outer diameter of the second shaft, and having a first beveled transition located between the first bottom cleaning pad and the first retainer. The side cleaning member further comprising a second rectangular retainer, a second rectangular bottom cleaning pad, and a beveled transition between the two, cut to match the shape of the first bottom cleaning member. The side cleaning member further comprising a first set of two rectangular side cleaning paddles attached to a first side of the second rectangular retainer extending beyond the outer diameter of the second shaft, and a second set of two rectangular side cleaning paddles are attached to a second side of the second rectangular retainer and extend beyond the outer diameter of said second shaft. The brush assembly further comprising a retention pin placed through the cleaning assembly and the upper and lower portions of the second shaft. A collet of reduced heat shrink material is fitted over the retention pin and a portion of the second end of the second shaft binding the second end of the second shaft.

These and other advantages will become readily apparent to the reader from the detailed description of the different forms of the invention, particularly when considered in combination with the drawing figures accompanying this application wherein:

BRIEF DESCRIPTION OF THE DRAWING FIGURES

DETAILED DESCRIPTION OF THE INVENTION

Figure 1:
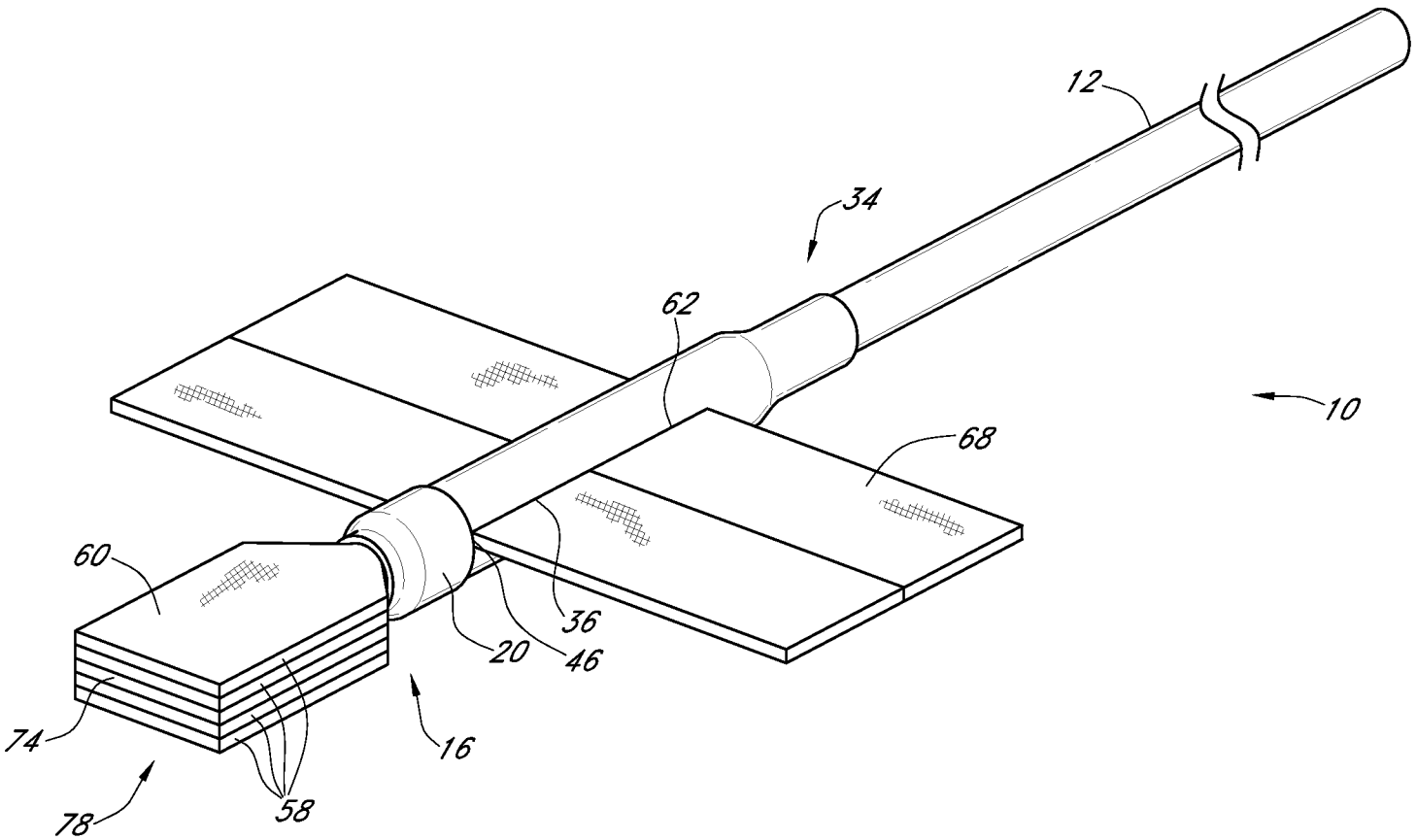
FIG. 1 is a perspective view of a brush assembly.
Figure 2:
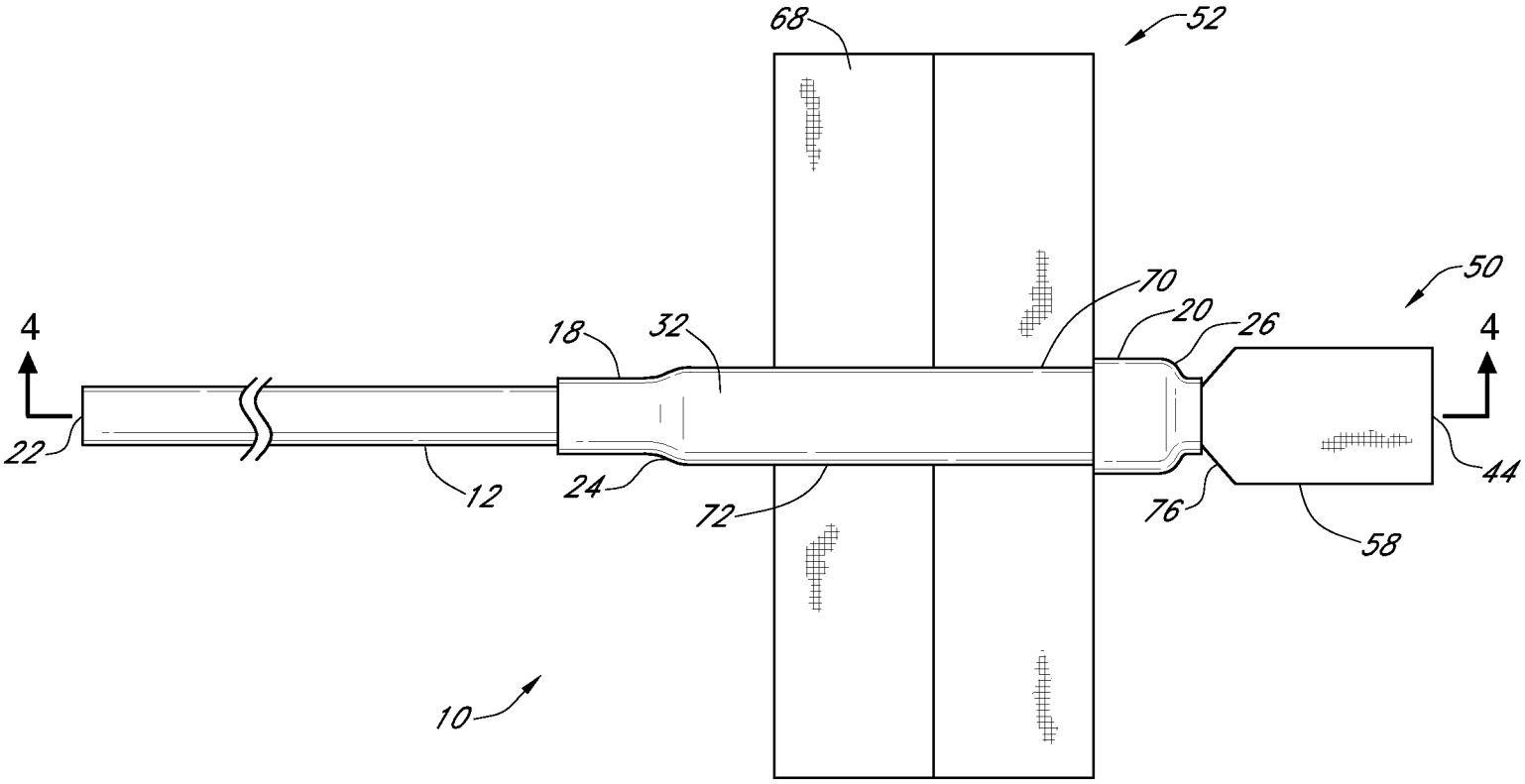
FIG. 2 is a plan view of a brush assembly.
Figure 3:
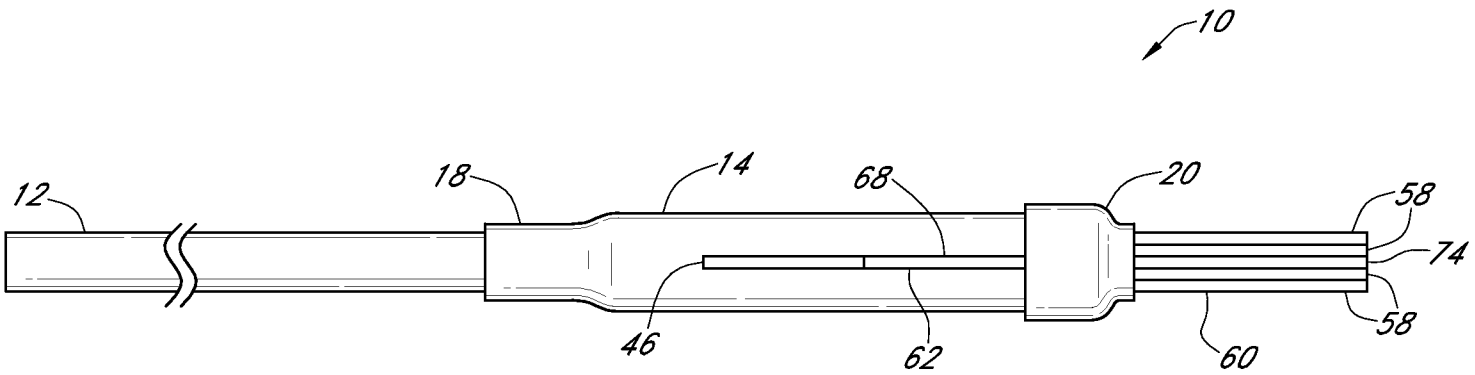
FIG. 3 is an elevation view of a brush assembly.
Figure 4:
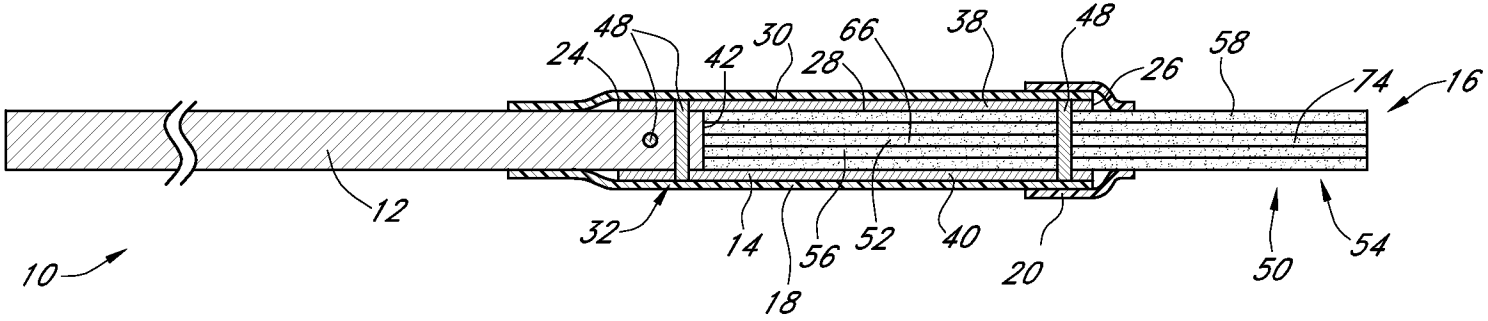
FIG. 4 is a cross-sectional view of a brush assembly taken along line 4-4 of FIG. 2.
Figure 5:
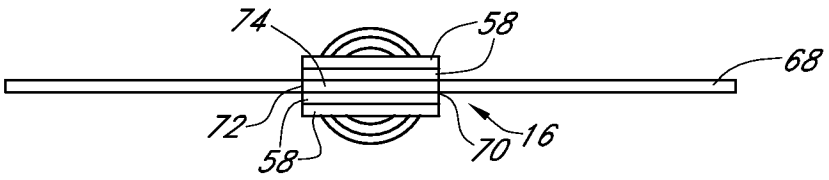
FIG. 5 is right side view of a brush assembly showing the bottom cleaning surfaces.
Figure 6:
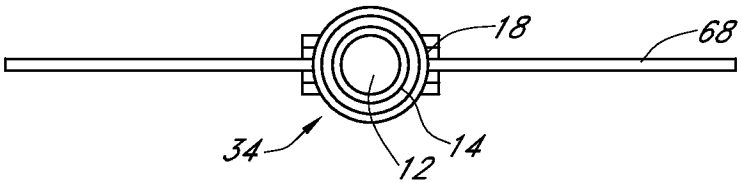
FIG. 6 is a left side view showing the shaft end of a brush assembly.

For the express purpose of the following description, the terms "upper," "lower," "right," "left," "top," "bottom," and derivatives thereof shall relate to the invention as oriented in FIG. 2. However, it should be understood the invention may assume different configurations unless expressly specified to the contrary. It should also be understood that the specific structures and processes illustrated in the accompanying drawing figures and described in the following specification are simply exemplary embodiments of the inventive concept, which are solely limited or restricted as defined in the appended claims.

Fundamentally, an improved brush assembly 10 is presented herein comprising: a first shaft 12, a second shaft 14, a cleaning assembly 16, a jacket 18, and a collet 20. The first shaft 12 allows the brush to enter and positions the cleaning assembly 16 within a container; therefore the first shaft 12 is preferably sized in length so that the brush assembly 10 exceeds the longest dimension of the container being cleaned, and is preferably sized in width so that it may be mounted into the chuck of a cordless hand drill, but is not so narrow as to fracture when the brush assembly 10 is rotated during its use. In one preferred form of the invention, the first shaft 12 is shaped in a solid cylindrical form, contains a central axis 22, and is constructed of ACETRON® GP, which is a relatively rigid, porosity free, acetal copolymer which is easy to sanitize. Some of the varied materials anticipated for use as a first shaft 12 include wood, plastics, and metals including stainless steels. Alternate geometries for use with first shaft 12 include square, rectangular, hexagonal, and polygonal forms.

A second shaft 14, comprising a first end 24, a second end 26, an inner diameter 28, and an outer diameter 30, is also provided. The second shaft 14 is received on a first end 42 of the first shaft 12; preferably by inserting the first end of the first shaft 12 into a recess located in first end 24 of said second shaft 14. A preferred form of the second shaft 14 includes a cylindrical hollow tube, provided with an inner diameter 28 sized to mate with the first shaft 12 in a press fit. Again, alternate geometries for use with second shaft 14 include square, rectangular, hexagonal, and polygonal forms, both solid and hollow.

In one preferred form of the invention, the second shaft 14 is shaped in a hollow cylindrical form, and is constructed of polyethylene tubing which is commonly available in the form of 'water line' found in various hardware stores. The tubing, in this preferred form of the invention is slid overtop the first shaft 12, creating an overlapping region 32 and a shaft assembly 34. The overlapping region is preferably sized to be approximately ⅓ the length of the hollow shaft 14. An optional adhesive may also be placed into the overlapping region 32, further securing the hollow shaft 14 to the first shaft 12.

The second shaft 14 further contains a slot 36, which is an area of material removal bounded by an upper portion 38 and a lower portion 40 on said second shaft 14. The slot is preferably placed through the second shaft 14, and extends longitudinally along the second shaft 14, intermediate to its first 24 and second ends 26. In a preferred form of the invention, slot 36 is bounded by the end of the first shaft 12 (beginning of overlapped region 32) and the second end 26 of the hollow shaft 14. Slot 36 is preferably located along the hollow shaft's 14 central axis 44 and is sized in width 46 to contain and restrain an attached cleaning assembly 16.

One or more optional retention pins 48 may be inserted through the overlapping portion 32 of the second shaft 14 and the first shaft 12. In the preferred embodiment of the invention, two retention pins 48 are used, staggered 90 degrees relative to each other, and are inserted through the entirety of the first shaft 12 and second shaft 14 anchoring them to one another and assisting in the transmittal of rotational torque from the first shaft 12 to the second shaft 14. The retention pins 48 are preferably constructed from commercially available solid materials which may include staples, nails or pins.

A jacket 18 is disposed over a portion of the second shaft 14, protecting the assembly, and rendering it easier to sanitize. Jacket 18 may be constructed of any material which conforms to the brush assembly 10, including over molded plastic and rubber, and is not limited to the preferred embodiment stated herein. In the preferred embodiment of the invention, the jacket is constructed of reduced heat shrink material 18 which is positioned to lie flush with the second shaft's 14 second end 26, and sized to tightly cover the entirety of said second shaft's 14 outer diameter 30, including retention pins 48 (if present), preferably extending onto a portion of the first shaft 12. The jacket of reduced heat shrink material 18 may be constructed of any commonly available heat shrink materials, and preferably from materials which are compatible for contact with foodstuffs and commercial cleaning agents.

The brush assembly 10, also contains a cleaning assembly 16 which is inserted into and retained within the slot 36 located between the upper 38 and lower portions 40 of the second shaft 14. The cleaning assembly 16 is preferably anchored within slot 36 with adhesive. Cleaning assembly 16 preferably comprises a plurality of bottom cleaning members 50, and at least one side cleaning member 52 which are arranged in a stacked formation 54. In the preferred form of the invention, the cleaning sub assembly 16 contains four bottom cleaning members 50, and one side cleaning member 52, wherein the side cleaning member 52 is located in the middle of the stack 54.

A bottom cleaning member 50 is provided further comprising a first retainer 56 and a first bottom cleaning pad 58 which are preferably constructed from a fibrous cloth material such as a ShamWow™ style chamois material, although other materials are anticipated to be compatible with this device, including cloth and plastic pads. The first retainer 56 is preferably rectangular in shape and comprises a first width corresponding to said second shaft's 14 outer diameter 30, and a first length corresponding to the predetermined length 62 of slot 36. The first bottom cleaning pad 58 is preferably rectangular in shape, attached to said first retainer, and further comprises a first bottom cleaning paddle 60. The bottom cleaning paddle 60 is preferably sized to contain a width wider than the hollow shaft's 14 outer diameter 30, extending beyond the second end 26 of the hollow shaft when the first retainer 56 is fully inserted in the hollow shaft's 14 slot 36, and further includes a first beveled transition 64 located between the first bottom cleaning pad 58 and the first retainer 56.

A side cleaning member 52 is provided comprising a second retainer 66, at least one side cleaning paddle 68 attached to a first 70 or a second side 72 of said second retainer 66, a second bottom cleaning pad 74, and is preferably constructed from a fibrous cloth material such as a ShamWow™ style chamois material. Preferably, the dimensions of the second retainer 66, the second bottom cleaning pad 74, and the beveled transition 76, are sized to match the respective dimensions of the component parts of the bottom cleaning member 50. The first side cleaning paddle 68 is attached to either the first side 70 or second side 72 of the second retainer 66 and is sized to extend beyond the outer diameter 30 of the hollow shaft. Preferably, the side cleaning member comprises two first side cleaning paddles 68 which are attached to the first side 70 of the second retainer 66, are rectangular in shape, and lie adjacent to one another in a series arraignment 78 without substantial gapping between paddles 68. Preferably two additional second side cleaning paddles 68 are attached to the second side 72 of the second retainer 66, are also rectangular in shape, and lie adjacent to one another in a series arraignment 78 without substantial gapping between paddles 68. Thus, in the preferred form of the invention, the cleaning sub assembly comprises four side cleaning paddles (two on either side of the retainer 66.)

In the preferred form of the brush assembly 10, the cleaning assembly 16, is fully inserted into second shaft's 14 slot 36, and adhesive is placed into the slot 36, and onto the cleaning assembly's 16 first and second retainers 56 and 66, binding them together. A retention pin 48 is placed through the cleaning assembly 16, the upper 38, and lower portions 40 of the second shaft 14, further retaining the cleaning assembly 16 in the second shaft's 14 slot 36, while a collet 36 is tightly fitted over the retention pin 48 and a portion of the second end 26 of said hollow shaft 14 binding the second end 26 of the hollow shaft 14 together, retaining the cleaning assembly 16 within the hollow shaft's 14 slot 36. Collet 36, similar to the jacket 18, may be constructed of any material which conforms to the brush assembly 10, including over molded plastic, rubber, metal clamps, and zip ties, and is not limited to the preferred embodiment, which is a reduced heat shrink material. Preferably collet 36, will be a material similar to jacket 18, and may be contiguous with the jacket 18.

The foregoing manufacturing process details the assembly of the preferred components used in the preferred embodiment of the inventive bottle cleaning brush and is in no way limiting. Modifications to the method of manufacture of the invention will occur to those skilled in the art and those who make or use the invention. Consequently, the forgoing process is considered that of the assembly of the preferred embodiment only.

One process for creating the inventive bottle cleaning brush includes procuring sufficient lengths of the first shaft 12 and a second shaft 14 which are then cut and trimmed to the desired lengths. Adhesive is applied to the first end 24 of the second shaft 14, and the first end 24 is inserted overtop a portion of the first shaft 12 creating an overlapped region 32. In the preferred form of the invention, a first pin 48 is inserted through the overlapping portion's 32, hollow second shaft 14 and first shaft 12. A second pin 48 is then inserted at a 90 degree angle to the first pin 48, anchoring the two parts together.

The second shaft 14 is then cut along its central axis 44, from the second end 26 to the overlapping section 32, creating a slot 36 bounded by an upper portion 38 and a lower portion 40 on the second shaft 14, having a width sufficient to fit the cleaning assembly 16.

A portion of heat shrink material is cut to an appropriate length, and is inserted over the second shaft 14, and pins 48, preferably from the second end 26, and is of a length to cover the outer diameter of the entirety of the second shaft 14, and the overlapping section 32, leaving one end of the jacket of heat shrink material 18 flush with the second end 26 of the shaft 14. The jacket of heat shrink material 18 is then heated reducing its size. A razor knife (not shown) is then used to cut the heat jacket 18 along the slot 36, slitting the material and re-opening the slot 36.

A side wall cleaning member 52 is then trimmed from a fibrous cloth material, comprising a rectangular retainer 66, at least one side cleaning paddle 68, and a bottom cleaning pad 74. In the preferred form of the invention, the side wall cleaning member contains two rectangular shaped side paddles 68, located adjacent to one another and extending from the sides of the retainer 70, 72. The retainer 66 is preferably sized in length to match the length of the slot 36, and width of the outer diameter 30 of the second shaft 14. A bottom cleaning pad 74 extends from the bottom of the retainer 66 and is sized to extend beyond the second end 26 of the second shaft 14. The bottom cleaning pad is preferably rectangular in shape, and contains a width larger than the outer diameter 30 of the second shaft 14. An optional bevel 76 transitions between the bottom cleaning pad 74 and the retainer 66, preventing tears in the material. The side wall cleaning member 52 is preferably cut from a single sheet of material.

A number of bottom cleaning members 50 are also trimmed from a fibrous cloth material, and are sized to match the sidewall cleaning member 52, except that the bottom cleaning members 50 do not contain any side paddles 68. In the preferred form of the invention, four bottom cleaning members 50 are needed.

After the bottom and side cleaning members are cut, the members 50, 52 are stacked 54 upon one another, preferably in the following order: two bottom cleaning members 50, then one side cleaning member 52, and then two more bottom cleaning members 50. Each layer is arranged so that their individual respective retainers 56, 66 are aligned and overlapped. The members 50, 52 are then joined preferably by running a bead of hot glue along the length of each member's retainer 56, 66 allowing them to bond together as the glue cools.

The cleaning assembly 16 is then inserted, retention end 56 and 66 first, into the second end 26 of the second shaft 14, and down the slot 36. Additional adhesive is then applied to the inside of the second shaft's 14 slot 36 adjacent to the exposed faces of the retainers 56 of the cleaning assembly 16. This joins and retains the cleaning assembly 16 to the second shaft's 14 slot 36.

A third pin is then inserted through the second shaft's 14 upper portion 38, through the cleaning assembly 16, and through the shaft's lower portion 40 retaining the cleaning assembly 16 within the slot 36. A second piece of heat shrink tube, called a collet 20, is then cut and fitted over the bottom cleaning pads 58, 74 of the cleaning assembly 16 until it covers the upper and lower 38, 40 portions of the second shaft. Preferably the collet 20 will cover the second end 26, and part of the beveled portion 76 of the cleaning members 50, 52. The collet 20 is then heated reducing its size, securing the second end 26 of the second shaft 14.

The brush and process for creating the brush detailed herein are considered that of the preferred embodiments only. Modifications of the invention will occur to those skilled in the art and those who make or use the invention. Hence, specific dimensions and other physical characteristics relating to the embodiments or tooling described shall not be considered limiting, unless expressly stated otherwise in the specification or the claims. Therefore, it is understood that the embodiments shown in the drawings and the examples set forth herein are described merely for illustrative purposes and not intended to limit the scope of the invention's claims as interpreted according to the principles of patent law, including the doctrine of equivalents.

The invention claimed is:

1. A brush assembly comprising:

a first shaft;

a second shaft coupled to an end of said first shaft, said second shaft further comprising a first end, and a second end;

a jacket disposed over a portion of said second shaft;

a slot extending through said second shaft intermediate said second shaft's said first and second ends;

a cleaning assembly inserted into and retained within said slot, said cleaning assembly further comprising;

a bottom cleaning member comprising;

a first retainer having a first length, and a first bottom cleaning pad attached to said first retainer, said first bottom cleaning pad extending beyond said second end of said second shaft; and a side cleaning member comprising;

a second retainer, and at least one side cleaning paddle attached to a side of said second retainer, extending beyond an outer diameter of said second shaft; and a collet disposed over said second end of said second shaft.

2. The brush assembly as defined in claim 1 wherein said bottom cleaning member and said side cleaning member are constructed of a fibrous cloth material.

3. The brush assembly as defined in claim 1 further comprising a pin inserted through said first shaft and said second shaft.

4. The brush assembly as defined in claim 1 wherein said side cleaning member further contains a plurality of side cleaning paddles.

5. The brush assembly as defined in claim 1 wherein said side cleaning paddle is rectangular in shape.

6. The brush assembly as defined in claim 1 wherein said side cleaning member contains a plurality of side cleaning paddles arranged adjacent one another along part of said side of said second retainer.

7. The brush assembly as defined in claim 1 wherein said first bottom cleaning pad is rectangular in shape.

8. The brush assembly as defined in claim 7 wherein said bottom cleaning pad and said side cleaning paddle member are constructed of a fibrous cloth material.

9. The brush assembly as defined in claim 1 further comprising a plurality of said bottom cleaning members and at least one side cleaning member having an integral bottom cleaning pad, wherein said side cleaning member's integral bottom pad is centered in-between said plurality of bottom cleaning members.

10. The brush assembly as defined in claim 9 wherein said bottom cleaning members and said side cleaning member further comprise a fibrous cloth material.

11. The brush assembly as defined in claim 9 further comprising four of said bottom cleaning members and one side cleaning member having an integral bottom cleaning pad.

12. The brush assembly as defined in claim 9, wherein said integral bottom cleaning pad and said bottom cleaning members are similar in size and shape.

13. A brush assembly comprising:

a first shaft;

a second shaft coupled to an end of said first shaft, said second shaft comprising a first end, a second end and an outer diameter;

a jacket fitted over said second shaft and a portion of said first shaft;

a slot of predetermined length extending through said shaft intermediate said second shaft's first and said second ends;

a cleaning assembly inserted into and retained within said slot, said cleaning assembly further comprising;

a bottom cleaning member constructed of a fibrous cloth material comprising;

a first retainer comprising a first width no wider than said second shaft's said outer diameter, and a first length no longer than said slot's said predetermined length, a first bottom cleaning pad attached to said first retainer, extending beyond said second end of said second shaft, having a width wider than said outer diameter of said second shaft; and a side cleaning member constructed of a fibrous cloth material comprising;

a second retainer sized to match said bottom cleaning member's said first retainer, a second bottom cleaning pad sized to match said bottom cleaning member's said first bottom cleaning pad, and a first side cleaning paddle attached to a first side of said second retainer, said paddle extending beyond said outer diameter of said second shaft;

a second side cleaning paddle attached to a second side of said second retainer, said paddle extending beyond said outer diameter of said second shaft and;

a collet disposed about said second end of said second shaft.

14. The brush assembly as defined in claim 13 further comprising a pin inserted through said first and second shafts.

15. The brush assembly as defined in claim 13, wherein said slot extends from said second shaft's said second end to a point proximate said end of said first shaft.

16. The brush assembly as defined in claim 13 wherein said bottom cleaning pad and said side cleaning paddles are rectangular in shape.

17. The brush assembly as defined in claim 13 further comprising a retention pin placed through said cleaning assembly, and said second shaft.

18. The brush assembly as defined in claim 13 further comprising four bottom cleaning members.

19. The brush assembly as defined in claim 13 further comprising a plurality of said bottom cleaning members and at least one side cleaning member having an integral bottom cleaning pad, wherein said side cleaning member's integral bottom pad is centered in-between said plurality of bottom cleaning members.

20. A brush assembly comprising:

a solid cylindrical first shaft;

a hollow cylindrical second shaft affixed to a first end of said first shaft with an adhesive, said second shaft comprising a first end, a second end and an outer diameter;

a plurality of pins inserted through said first and said second shaft anchoring them together;

a jacket of reduced heat shrink material disposed over the entirety of said second shaft and a portion of said first shaft;

a slot of predetermined length extending through said shaft extending from said second shaft's said second end to a point proximate said end of said first shaft;

a cleaning assembly inserted into and retained within said slot by an adhesive, said cleaning assembly further comprising;

four bottom cleaning members constructed of a fibrous cloth material comprising;

a first rectangular retainer comprising a first width corresponding to said second shaft's said outer diameter, and a first length corresponding to said predetermined length of said slot, a first rectangular bottom cleaning pad attached to said first retainer, extending beyond said second end of said second shaft, having a width wider than said outer diameter of said second shaft, and a first beveled transition located between said first bottom cleaning pad and said first retainer; and a side cleaning member constructed of a fibrous cloth material comprising;

a second rectangular retainer sized to match said bottom cleaning member's said first rectangular retainer, a second rectangular bottom cleaning pad sized to match said bottom cleaning member's said first rectangular bottom cleaning pad, a second beveled transition between said second bottom cleaning pad and said second rectangular retainer, a first set of two rectangular side cleaning paddles attached to a first side of said second rectangular retainer and extending beyond said outer diameter of said second shaft;

a second set of two rectangular side cleaning paddles attached to a second side of said second rectangular retainer, extending beyond said outer diameter of said second shaft;

a retention pin placed through said cleaning assembly and said second shaft; and a collet of reduced heat shrink material disposed over said retention pin and said second end of said second shaft.

* * * * *